US005863876A

United States Patent [19]

Lance-Gómez et al.

[11] Patent Number: 5,863,876

[45] Date of Patent: Jan. 26, 1999

[54] IN-TANK TOILET CLEANSING BLOCK HAVING POLYACRYLIC ACID/ACRYLATE

[75] Inventors: Edward T. Lance-Gómez; Jerome J. Veltman, both of Racine, Wis.

[73] Assignee: S. C. Johnson & Son, Inc., Racine, Wis.

[21] Appl. No.: 799,666

[22] Filed: Feb. 11, 1997

[51] Int. Cl.[6] ..... C11D 17/00; C11D 1/24; C11D 3/37; C11D 3/40

[52] U.S. Cl. ..... 510/193; 510/445; 510/447; 510/448; 510/451; 510/476; 510/495

[58] Field of Search ..... 510/191, 192, 510/193, 445–448, 451, 476, 495, 533; 422/37; 4/222–224, 229–231

[56] References Cited

U.S. PATENT DOCUMENTS

| | | | |
|---|---|---|---|
| 4,200,606 | 4/1980 | Kitko | 422/37 |
| 4,248,827 | 2/1981 | Kitko | 422/37 |
| 4,269,723 | 5/1981 | Barford et al. | 510/192 |
| 4,283,300 | 8/1981 | Kurtz | 252/180 |
| 4,302,350 | 11/1981 | Callicott | 510/193 |
| 4,361,492 | 11/1982 | Dubin | 252/175 |
| 4,374,572 | 2/1983 | Callicott | 239/37 |
| 4,428,872 | 1/1984 | Callicott | 510/193 |
| 4,431,547 | 2/1984 | Dubin | 210/701 |
| 4,452,714 | 6/1984 | Small | 510/192 |
| 4,476,046 | 10/1984 | Wong et al. | 510/192 |
| 4,477,363 | 10/1984 | Wong et al. | 510/192 |
| 4,502,978 | 3/1985 | Romberger et al. | 252/398.2 |
| 4,668,475 | 5/1987 | Meloy | 422/37 |
| 4,711,740 | 12/1987 | Carter et al. | 510/476 |
| 4,722,801 | 2/1988 | Bunczk et al. | 510/193 |
| 4,738,728 | 4/1988 | Barford et al. | 137/34 |
| 4,780,236 | 10/1988 | Bunczk et al. | 510/193 |
| 4,787,984 | 11/1988 | Hutchings et al. | 210/698 |
| 4,861,511 | 8/1989 | Kaplan | 510/193 |
| 4,861,514 | 8/1989 | Hutchings | 510/102 |
| 4,899,398 | 2/1990 | Hutchings et al. | 510/101 |
| 4,911,858 | 3/1990 | Bunczk et al. | 510/193 |
| 4,911,859 | 3/1990 | Bunczk et al. | 510/100 |
| 5,043,090 | 8/1991 | Camp et al. | 510/192 |
| 5,188,755 | 2/1993 | Chang et al. | 510/193 |
| 5,205,955 | 4/1993 | Bunczk et al. | 510/192 |
| 5,336,427 | 8/1994 | Bunczk et al. | 510/192 |
| 5,449,473 | 9/1995 | Bunczk et al. | 510/192 |

FOREIGN PATENT DOCUMENTS

| | | |
|---|---|---|
| 96/28536 WO | 9/1996 | WIPO . |
| 96/28536A | 9/1996 | WIPO . |

OTHER PUBLICATIONS

Two pages of National Starch ads entitled "Versaflex 157" and Versaflex 207, undated, admitted prior art.

*Primary Examiner*—Ardith Hertzog

[57] ABSTRACT

Disclosed herein is a toilet cleansing block containing a polyacrylate polymer and a lauryl benzene sulfonate salt surfactant. The block is essentially free of other polymers that sequester ions. The block is for immersion in toilet tanks, and inhibits toilet bowl ring and stain formation, particularly those caused by iron oxide.

7 Claims, No Drawings

IN-TANK TOILET CLEANSING BLOCK HAVING POLYACRYLIC ACID/ACRYLATE

CROSS REFERENCES TO RELATED APPLICATIONS

Not applicable.

STATEMENT REGARDING FEDERALLY SPONSORED RESEARCH

Not applicable.

BACKGROUND OF THE INVENTION

The present invention relates to cleansing blocks suitable for immersion in toilet tanks. The blocks are formulated to inhibit formation of toilet rings and surface stains.

Various cleansing blocks for use in toilet tanks and other water reservoirs are known. Such cleansing blocks typically contain a surfactant for cleaning, and often fillers, binders, colorants, extrusion aids and perfumes. They are designed to slowly release these materials into the toilet basin each time the toilet is flushed. See e.g. U.S. Pat. No. 5,336,427. The disclosure of this patent, and of all other publications referred to herein, are incorporated by reference as if fully set forth herein.

Such blocks should not include materials which leave undesirable residues in the toilet bowl, which are environmentally unacceptable, or which have unpleasant odors. While blocks having these desired attributes have been created, there are trade-offs between desired characteristics for each formulation. In particular, there is great difficulty in formulating a block that is long lasting, yet which sufficiently inhibits toilet bowl ring and stain formation.

Certain polymers have been added to assist in this regard. See e.g. U.S. Pat. Nos. 4,861,511, 4,899,398, 4,283,300, 4,302,350, and 4,428,872. However, such polymers are relatively costly, can require high concentrations in the toilet bowl in order to be effective, and in some cases can be counterproductive.

For example, in U.S. Pat. No. 4,861,511 a mixture of polyacrylate polymer with substantial amounts of an expensive polymer is stated to be required to achieve adequate results, particularly with respect to iron oxide deposits.

Thus, it can be seen that a need exists for an improved toilet cleansing block.

BRIEF SUMMARY OF THE INVENTION

In one aspect, the invention provides a water reservoir cleanser (e.g., in block form) having 1%–15% (preferably 1%–10%) by weight of a polymer selected from the group consisting of a polyacrylic acid and alkali metal salts of polyacrylic acid. There is also 20%–70% by weight of an alkali metal salt of a lauryl benzene sulfonate. The block can also have a dye, a filler/density aid (e.g., sodium sulfate) and a fragrance/extrusion aid (e.g., pine oil).

Importantly, the block is formed to have less than 1% of other "Sequestering Polymers", preferably none. Apart from the fact that other polymers can be expensive, they can inhibit the ability of compositions of the present invention to clean stains. A "Sequestering Polymer" is a polymer that sequesters iron oxide when added by itself with iron oxide to toilet bowl water. Typically these are polymers containing a carboxylic acid functionality (e.g. in at least one of the monomers). See e.g. U.S. Pat. No. 4,861,511.

The polymer is preferably homopolymer sodium polyacrylate in a form having an average molecular weight below 10,000. One version is sold by Rohm & Haas Co. as Acusol 445 ND with a molecular weight of 4,500. Other preferred polymers are potassium polyacrylate and polyacrylic acid itself.

In another embodiment, the invention provides a method of cleaning a basin of a toilet. One immerses one of the above blocks in a water reservoir for a toilet basin, allows a portion of the block to dissolve so as to create a dissolved concentration of polymer in the toilet tank water of at least 0.1 ppm, preferably 0.1 ppm to 3 ppm, even more preferably 1 ppm to 1.2 ppm, and then flushes the toilet.

The choice of the dye coloring agent will largely depend on the color desired for the water into which the lavatory cleanser composition is to be dispensed. A preferred coloring agent is Acid Blue 9, notwithstanding that this dye contains manganese. Other suitable dyes are described in U.S. Pat. No. 5,336,427. The amount of coloring agent or dye to be dispensed into the water will depend on the color intensity desired and the cost of the dye. The absorbance of the coloring agent may be determined for laboratory purposes through the use of a visible spectrophotometer, such as a Perkin-Elmer Model 552 spectrophotometer.

The amount of coloring agent delivered in the toilet bowl should be sufficient to provide an absorbance in a 1 cm spectrophotometric cell of from about 0.02 absorbance units ("a.u.") to about 0.2 a.u. when measured at its wavelength maxima. This is because consumers typically believe that a colored cleansing product is no longer working when it has a color intensity below this range.

To achieve adequate density so that the block won't float, and to keep costs to the minimum, inert fillers/density aids are preferably added (typically 5%–65% by weight). Inert salts are preferred for this purpose such as water-soluble inorganic or organic salts (or mixtures of such salts). Examples include various alkali metal and/or alkaline earth metal sulfates, chlorides, borates, and citrates. Specific inert salts are sodium sulfate, calcium sulfate, sodium chloride, potassium sulfate, sodium carbonate, lithium chloride, tripotassium phosphate, sodium borate, potassium fluoride, sodium bicarbonate, calcium chloride, magnesium chloride, sodium citrate, magnesium sulfate and sodium fluoride.

To achieve an even longer life (greater than 15 days in typical use; preferably greater than 30 days) a binder can also be included in the block in replacement for part of an inert filler. Preferred binders are cellulose based. Especially preferred binders are hydrated cellulose materials such as hydroxy alkyl cellulose (especially hydroxy ethyl cellulose or hydroxy propyl cellulose). Gum binders may also be used. Examples are guar, xanthin, tragacanth, carrageenan, karaya, or algin.

A perfume or fragrance can also be added, depending on the type of aroma that is to be imparted. For instance, pine, citrus and potpourri scents can be employed. An especially preferred pine scent can be provided by Unipine 85, a pine oil from Bushe, Boake and Allen, Inc. It has the added advantage of facilitating extrusion of the blocks during manufacture.

The block can also contain still other anionic surfactants. See generally U.S. Pat. No. 5,336,427.

The objects of the present invention therefore include providing a water reservoir cleaner of the above kind:

(a) that is effective in inhibiting toilet bowl ring and stain formation (particularly those due to iron oxide);

(b) which maintains toilet basins in a clean condition in normal use for an extended period; and (c) which uses environmentally acceptable and inexpensive components.

These and still other objects and advantages of the present invention (e.g., methods for using these blocks) will be apparent from the description which follows. The following description is merely of the preferred embodiments. Thus, the claims should be looked to in order to understand the full scope of the invention.

DETAILED DESCRIPTION

Preferred cleansing blocks for use in a Vanish™ Power System dispenser (sold by S. C. Johnson & Son, Inc.) are:

| Ingredient | Weight % | Alternative Preferred Range |
|---|---|---|
| Acid Blue #9 dye (100% powder) | 20% | 8–25% |
| sodium polyacrylate (Acusol 445 ND) | 3% | 1–10% |
| Unipine 85 (pine oil) | 6% | 3–8% |
| sodium lauryl benzene sulfonate (Ufaryl DL-85) | 55% | 40–60% |
| sodium sulfate | 6% | remainder |

When forming a block to be directly inserted in a toilet tank, 5–15% (e.g. 6%) can be a binder such as hydroxyethylcellulose (e.g. replace the sodium sulfate with the HEC).

We first create a homogeneous blend using a mixer such as a ribbon blender. The blend is then fed into the barrel of a screw extruder and passed through the extruder to form a continuous extrudate which is then cut to the size block desired.

The pressure through the die can be about 500–1250 psi. The barrel of the extruder can be maintained at less than 35° C. (e.g., an ambient temperature) by means of cooling water circulated through an external barrel jacket. The die head may be heated to assure a smoother surface of the product extrudate.

The block in the continuous extrudate form begins to cure upon leaving the extruder, and hence can be cut into cleansing blocks of requisite size by conventional cutting means downstream of the die and before substantially complete curing. The "block" need not be rectangular. It may be a tablet, disk, brick, or other solid mass, with or without crevices, holes or the like, and need not be formed by extrusion (albeit extrusion is preferred). Thus, any solid form mass is intended to be a "block" for purposes of this patent.

To use the blocks of the present invention, we place a block in a conventional toilet tank and flush the toilet in the usual manner.

Comparative Tests

We hang a 3"×6"×10" (approx. 7.6 cm×15.2 cm×25.4 cm) mild steel plate in the toilet tank. This plate formed and released rust into the tank water. Using vinyl coated spring clips at two corners we suspended a white ceramic tile so that half of the tile stood approximately vertically in the toilet bowl water. We then placed a test product or no product (control) into the toilet tank. We flushed the toilet periodically as per a protocol that represented the median consumer usage (10 flushes per day, no night flushes, etc.).

We then monitored instrumentally any coloration that occurred on the white tile by a Minolta Chroma Meter CR300 with DP310 processor, measuring Hunter Δb and ΔE on the tile by comparing measurements above and below the water line, and comparing a measurement taken at time 0 to the measurements at later time(s). We then visually monitored the appearance of the tile and the toilet bowl.

We compared the invention with equal amounts of a product containing 3% tyrene/maleic anhydride polymer (Versaflex 157 from National Starch), and with a control. The following are ΔE values:

| | 3% Acusol | 3% Versaflex | Control |
|---|---|---|---|
| 21 days | .93 | 2.11 | 1.14 |

We also compared the invention with controls over a shorter period, albeit with higher iron oxide exposure:

| | 3% Acusol | No Treatment | No Treatment | No Treatment |
|---|---|---|---|---|
| 7 days | 0.17 | 1.48 | 1.28 | 1.49 |
| 14 days | 0.17 | 2.65 | 2.57 | 2.60 |

The invention showed a strong ability to reduce inorganic staining at very low concentrations (0.1 ppm). We believe that this is due to a uniquely effective complexation of the soluble cations and insoluble particulates.

Industrial Applicability

The invention is useful in maintaining the cleanliness of toilet bowls associated with toilet tanks. It should also have applicability in other water reservoir systems (e.g. tanks for urinals).

We claim:

1. A water reservoir cleaner block, comprising:

1%–15% by weight of a sequestering polymer selected from the group consisting of a polyacrylic acid and an alkali metal salt of polyacrylic acid; and 20%–70% by weight of an alkali metal salt of a lauryl benzene sulfonate;

wherein the cleaner contains less than 1% of any other Sequestering Polymer; and wherein the block further comprises manganese.

2. The cleaner block of claim 1, wherein the cleaner is essentially free of any other Sequestering Polymer, and is in block form.

3. The cleaner block of claim 1, wherein the salt of a lauryl benzene sulfonate is sodium lauryl benzene sulfonate.

4. The cleaner block of claim 1, wherein the block comprises a dye that contains manganese.

5. The cleaner block of claim 1, wherein the sequestering polymer is a sodium polyacrylate having an average molecular weight below 5,000.

6. A method of cleaning a basin of a toilet comprising the steps of:

immersing a block of the claim 1 cleaner in a toilet tank for the toilet basin;

dissolving a sufficient amount of the block so as to create a dissolved concentration of the sequestering polymer of claim 1 in the toilet tank of between 0.1 ppm and 3 ppm; and flushing the toilet.

7. The method of claim 6, wherein the dissolved concentration is between 0.1 ppm and 1.2 ppm.

* * * * *